US005311850A

United States Patent [19]

Martin

[11] Patent Number: 5,311,850

[45] Date of Patent: May 17, 1994

[54] HIGH PRESSURE ELECTRONIC COMMON-RAIL FUEL INJECTION SYSTEM FOR DIESEL ENGINES

[76] Inventor: Tiby M. Martin, 3836 Holly La., Waterloo, Iowa 50702

[21] Appl. No.: 695,221

[22] Filed: May 3, 1991

Related U.S. Application Data

[60] Continuation-in-part of Ser. No. 508,068, Apr. 11, 1990, Pat. No. 5,035,221, which is a division of Ser. No. 295,588, Jan. 11, 1989, abandoned.

[51] Int. Cl.[5] ..... F02M 41/00

[52] U.S. Cl. ..... 123/456; 123/447; 123/467; 137/561 A

[58] Field of Search ..... 123/456, 447, 467, 452, 123/451; 137/561 A, 883, 884

[56] References Cited

U.S. PATENT DOCUMENTS

| | | | |
|---|---|---|---|
| 2,892,453 | 6/1959 | Stoll . | |
| 3,331,327 | 7/1967 | Roosa . | |
| 3,552,436 | 1/1971 | Stewart | 137/883 |
| 3,556,144 | 1/1971 | Bickers | 137/884 |
| 3,604,402 | 9/1971 | Hatz . | |
| 3,827,409 | 8/1974 | O'Neill . | |
| 3,844,263 | 10/1974 | Endo et al. . | |
| 3,949,713 | 4/1976 | Rivere . | |
| 3,971,259 | 7/1976 | Schottler . | |
| 4,215,662 | 8/1980 | Nozaki | 123/447 |
| 4,274,380 | 6/1981 | de Vulpillieres . | |
| 4,300,509 | 11/1981 | Schechter . | |

(List continued on next page.)

FOREIGN PATENT DOCUMENTS

| | | | |
|---|---|---|---|
| 0193098 | 9/1986 | European Pat. Off. . | |
| 575931 | 5/1933 | Fed. Rep. of Germany | 123/451 |
| 2221309 | 12/1973 | Fed. Rep. of Germany . | |
| 8806731 | 8/1988 | Fed. Rep. of Germany . | |
| 62-660 | 1/1987 | Japan . | |
| 63-85265 | 4/1988 | Japan . | |
| 2286867 | 11/1990 | Japan . | |
| 65846 | 7/1950 | Netherlands . | |
| 2118624 | 11/1963 | United Kingdom . | |

OTHER PUBLICATIONS

Schechter, Michael M. et al., "EMI-Series-Electromagnetic Fuel Injection Pumps," SAE Technical Paper Series 880421 (1988).

Weseloh, William, "EEC IV Full Authority Diesel Fuel Injection Control," SAE Technical Paper Series 861098 (1986).

Glikin, P. E., "An Electronic Fuel Injection System for Diesel Engines," SAE Technical Paper Series 850453 (1985).

Beck, N. John et al., "Direct Digital Control of Electronic Unit Injectors," SAE Technical Paper Series 840273 (1984).

Cross, R. K. et al., "Electronic Fuel Injection Equipment for Controlled Combustion in Diesel Engines," SAE Technical Paper Series 810258 (1981).

*Primary Examiner*—Carl S. Miller

*Attorney, Agent, or Firm*—Woodard, Emhardt, Naughton, Moriarty & McNett

[57] ABSTRACT

A fuel injection system having a novel electromagnetic actuated fuel pump in which four pumping elements, equally-spaced around a camshaft are mounted such that a pair of opposed pumping elements alternate to deliver pressure to a high pressure common rail with a second pair of the pumping pair of pumping elements. In one embodiment of the invention, the pumping process is mechanically actuated, and in another is electronically actuated. The high pressure common rail is adapted to reduce surges in the fuel pressure from the pump by using central and side chambers connected with cross-drilled orifices. The common rail has a relief valve for safety protection not to allow the pressure in the rail to exceed the maximum preset pressure. The electromagnetic injector has a pressure balanced control valve to control fuel flow to the nozzle and has a pressure assistance mechanism at the end of injection to obtain a sharp end of injection. Also, at the beginning of the next injection, the needle opening can be slowed down to meet the engine requirements.

9 Claims, 15 Drawing Sheets

U.S. PATENT DOCUMENTS 4,392,466 7/1983 Mowbray et al. .
4,509,691 4/1985 Skinner .
4,527,737 7/1985 Deckard .
4,539,959 9/1985 Williams .
4,550,875 11/1985 Teerman et al. .
4,601,275 7/1986 Weinand .
4,603,671 8/1986 Yoshinaga et al. .
4,673,337 6/1987 Miller .
4,759,382 7/1988 Harel ..... 137/561 A
4,777,921 10/1988 Miyaki et al. .
4,905,655 3/1990 Maekawa .
4,922,958 5/1990 Lemp ..... 137/561 A
4,955,409 9/1990 Tokuda ..... 123/456
5,143,039 9/1992 Gmelin ..... 123/456

HIGH PRESSURE ELECTRONIC COMMON-RAIL FUEL INJECTION SYSTEM FOR DIESEL ENGINES

REFERENCE TO RELATED APPLICATIONS

This application is a continuation-in-part of pending U.S. patent application Ser. No. 07/508,068, filed Apr. 11, 1990, which is a divisional application of U.S. patent application Ser. No. 07/295,588, filed Jan. 11, 1989, now abandoned.

BACKGROUND OF THE INVENTION

This invention is related to a high-pressure, common rail, fuel injection system for injecting metered amounts of highly pressurized fuel into the cylinder of a diesel engine.

Conventional fuel injection systems employ a "jerk" type fuel system for pressurizing and injecting fuel into the cylinder of a diesel engine. A pumping element is actuated by an engine-driven cam to pressurize fuel to a sufficiently high pressure to unseat a pressure-actuated injection valve in the fuel injection nozzle. In one form of such a fuel system having an electromagnetic unit injector, the plunger is actuated by an engine driven cam to pressurize the fuel inside the bushing chamber when a solenoid is energized and the solenoid valve is closed. The metering and timing is achieved by a signal from an electronic control module (ECM) having a controlled beginning and a controlled pulse. In another form of such a fuel system, the fuel is pressurized by an electronic or mechanical pumping assembly into a common rail and distributed to electromagnetic nozzles, which inject pressurized fuel into the engine cylinders. Both the electronic pump and the electromagnetic nozzles are controlled by the ECM signal.

One problem with using a common rail results from the high pressures experienced in diesel engines, which are in the neighborhood of 20,000 psi. Another problem in conventional fuel injection systems is achieving a controlled duration and cut-off of the fuel injection pressure. Standard fuel injection systems commonly have an injection pressure versus time curve in which the pressure increases to a maximum and then decreases, following a somewhat skewed, triangularly-shaped curve. Such pressure versus time relationship initially delivers a relatively poor, atomized fuel penetration into the engine cylinder because of the low injection pressure. When the pressure curve reaches a certain level, the pressure provides good atomization and good penetration. As the pressure is reduced from its peak pressure, the decreasing pressure again provides poor atomization and penetration, and the engine discharges high emissions of particulates and smoke.

One of the objects of fuel injection designers is to reduce unburned fuel by providing a pressure versus time curve having a square configuration, with an initially high pressure increase to an optimum pressure, providing good atomization, and a final sharp drop to reduce the duration of poor atomization and poor penetration.

Examples of some prior art fuel injection nozzles may be found in U.S. Pat. No. 4,527,737 which issued July 9, 1985 to John I. Deckard; U.S. Pat. No. 4,550,875 which issued Nov. 5, 1985 to Richard F. Teerman, Russell H. Bosch, and Ricky C. Wirth; U.S. Pat. No. 4,603,671 which issued Aug. 5, 1986 to Turo Yoshinaga, et al.; U.S. Pat. No. 3,331,327 which issued to Vernon E. Roosa on Jul. 18, 1967; and U.S. Pat. No. 4,509,691 which issued Apr. 9, 1985 to Robert T. J. Skinner. An example of a high pressure common rail of the prior art may be found in U.S. Pat. No. 4,777,921, which issued Oct. 18, 1988, to Miyaki et al. Literature pertaining to electromagnetic fuel injection pumps may be found in Paper No. 880421 of the SAE Technical Paper Series entitled "EMI - Series - Electromagnetic Fuel Injection Pumps" discussed at the Feb. 29–Mar. 4, 1988 International Congress & Exposition at Detroit, Mich. Other literature pertaining to the subject include: SAE Technical Paper Series No. 840273 discussed Feb. 27–Mar. 2, 1984 at the International Congress & Exposition, Detroit, Mich.; SAE Technical Paper Series 850453 entitled "An Electronic Fuel Injection System for Diesel Engines" by P. E. Glikin discussed at the International Congress & Exposition at Detroit, Mich. on Feb. 25, 1985; SAE Technical Papers Series 810258 by R. K. Cross, P. Lacra, C. G. O'Neill entitled "Electronic Fuel Injection Equipment for Controlled Combustion in Diesel Engines," dated Feb. 23, 1981; SAE Technical Paper Series 861098 entitled "EEC IV—Full Authority Diesel Fuel Injection Control" by William Weseloh presented Aug. 4, 1986; and, United Kingdom Patent Application No. GB-2118624A filed Mar. 3, 1983 by Henry Edwin Woodward.

SUMMARY OF THE INVENTION

The broad purpose of the present invention is to provide an improved high pressure common rail fuel injection system. In the preferred embodiment, the system employs a novel electromagnetic injector having a needle valve with an inner end attached to a spring cage, which is pressure assisted at the closing and slowed down at the opening by residual pressure maintained in a balancing chamber within the spring cage.

Fuel is delivered to the injector by a solenoid-actuated valve. The high pressure fuel biases the needle valve to an open position. When the injector solenoid is de-energized, the solenoid valve stops fuel pressure access to the needle and the pressure drops in the nozzle due to nozzle bleeding into the engine's combustion chamber. At the end of injection, a portion of the high-pressure fuel is bypassed to the balancing chamber to assist the spring and urge the needle valve towards its closed position.

The pressure assistance to needle valve closure is adjustable by sizing the orifice between the upper and lower chambers of the spring cage to restrict the fuel through the orifice to the required pressure for assistance. A sized orifice in the lower balancing chamber will assist the needle opening at the next injection slowing it down to the engines requirements.

The system of the invention employs a novel multi-element fuel pump. Four pumping elements are mounted about a camshaft having a pair of lobes disposed at 180 degrees apart. When the camshaft turns 90 degrees, it moves a first pair of opposed pumping means in a delivery motion, and the other two pumping means are in a suction motion. As the camshaft continues its rotation, the two pair of pumping elements alternate in delivering fuel toward the corresponding solenoid valve assemblies. In one embodiment, the pump is actuated by two solenoid valve assemblies in response to an electrical signal from an electronic control module. In another embodiment, the pumping elements are mechanically actuated.

Two forms of common rail are disclosed. In both forms, the common rail has a one-piece metal housing having a rectangular shape. Fuel is delivered from the pump in one direction into the common rail and discharged at right angles to the injectors. One form of common rail is applied to the engines having cylinders arranged in "V" configuration and has a central chamber where the fuel enters, and two side chambers where the fuel exits to the electromagnetic injectors. The central chamber is connected to the side chambers through cross-drilled holes. This will help to eliminate the pressure fluctuations in the central passage of the rail caused by the pumping strokes and reflected waves, and have a constant pressure and fuel distribution in the side chambers. In diesel engines having the cylinders disposed in an "in line" configuration, the common rail has a central chamber and a side chamber, connected with cross-drilled holes.

The pressure in the common rail is monitored by the electronic control module through a pressure sensor mounted on the common rail. The electronic control module will maintain the required pressure in the rail by adjusting accordingly the signal to the solenoid valve assemblies.

One embodiment of the present invention is a high pressure common rail for use in a diesel fuel injection system comprising a body having a longitudinal central chamber adapted to receive fuel under pressure and one or more side chambers adapted to discharge fuel under pressure, and cross-drilled passage means connecting the central chamber with the side chambers to eliminate the pumping stroke effect and the wave reflection effect in fuel entering the central chamber under pressure and to thereby provide a constant pressure and fuel distribution in pressurized fuel discharged from the side chambers.

Another embodiment of the present invention is a fuel pump for a diesel engine fuel injection means comprising a body adapted to receive fuel from a source, a rotatable camshaft supported in the body so as to be rotatable about an axis, and having a pair of cam lobes including a first cam lobe and a second cam lobe disposed 180 degrees apart and adapted to rotate in an annular path about the axis of rotation of the camshaft, at least one pair of reciprocating pumping elements mounted in the body perpendicular to the axis of rotation of the camshaft, each of the pumping elements including an elongated plunger having an axial passage, including a first end and a second end, the first end being connected to a source of liquid fuel, a structure slideably mounted on the plunger so as to form an expandable chamber at the second end of the axial passage, and being movable either to enlarge or reduce the volume of the chamber depending upon the direction of relative motion of the structure and the plunger, tappet means connecting the camshaft to the structure such that as the chamber is being enlarged in volume, fuel is received therein, and as the chamber is being reduced in volume, fuel is discharged therefrom, and means for fluidly connecting the pumping elements to fuel injection means for passing fuel under pressure thereto in response to rotation of the camshaft.

Another embodiment of the present invention is an electromagnetic injection injector for supplying fuel to an internal combustion engine comprising an injector body having an upper portion and a lower portion, and having an internal passage means with a first end in the upper portion for receiving pressurized fuel and a second end in the lower portion for passing pressurized fuel from the passage, a solenoid-actuated first valve slideably mounted at the first end of the passage means having a pressure balanced annulus operable between a solenoid-energized position in which high pressure fuel is delivered through the annulus to the passage means, and a solenoid de-energized position in which high pressure fuel is blocked by the annulus from passing to the passage means; a needle valve movable in the body to control the flow of pressurized fuel through the second end of the passage means, the needle valve being movable in a first direction toward an open position for passing pressurized fuel through the second end of the passage means when the solenoid-actuated valve is in the solenoid-energized position, and an opposite, second direction toward a closed position for blocking pressurized fuel from passing through the second end of the passage means when the solenoid-actuated valve is in the solenoid de-energized position, a spring cage forming a seat for the needle valve in the body adjacent the second end of the passage in fluid communication with the passage means, biasing the needle valve in the second direction, and having an upper balancing chamber and a lower balancing chamber, and a first sized orifice therebetween, and an adjustable pressure balanced second valve slideably mounted on the lower portion of the body and having means operable to communicate pressurized fuel into the spring cage to further bias the needle valve in the second direction to a closed position when the solenoid-actuated valve is in the solenoid de-energized position to thereby obtain a sharp end of injection, and a second sized orifice in the lower balancing chamber in fluid communication with means to maintain a residual fuel pressure within the spring cage when the solenoid-actuating valve is in the solenoid de-energized position to thereby slow the movement of the needle valve in the first direction toward an open position when the solenoid-actuated valve is next in the solenoid-energized position.

Another embodiment of the invention is a high pressure, common rail, fuel injection system for injecting metered amounts of highly pressurized fuel into the cylinder of a diesel engine comprising a first body adapted to receive fuel from a source, a rotatable camshaft supported in the first body so as to be rotatable about an axis, and having a pair of cam lobes including a first cam lobe and a second cam lobe disposed 180 degrees apart and adapted to rotate in an annular path about the axis of rotation of the camshaft, at least one pair of reciprocating pumping elements mounted in the first body perpendicular to the axis of rotation of the camshaft, each of the pumping elements including an elongated plunger having an axial passage, including a first end and a second end, the first end being connected to a source of liquid fuel, a structure slideably mounted on the plunger so as to form an expandable chamber at the second end of the axial passage, and being movable either to enlarge or reduce the volume of the chamber depending upon the direction of relative motion of the structure and the plunger, tappet means connecting the camshaft to the structure such that as the chamber is being enlarged in volume, fuel is received therein, and as the chamber is being reduced in volume, fuel is discharged therefrom, means for fluidly connecting the pumping elements to common rail means for passing fuel under pressure thereto in response to rotation of the camshaft, the common rail means including a second body having a longitudinal central chamber adapted to receive fuel under pressure from the first body and one or more side chambers adapted to discharge fuel under pressure, cross-drilled passage means connecting the central chamber with the side chambers to eliminate the pumping stroke effect and the wave reflection effect in fuel under pressure and to provide a constant pressure and fuel distribution in fuel discharged from the side chambers, means for fluidly connecting the common rail means to fuel injection means for passing fuel under pressure thereto in response to rotation of the camshaft, the fuel injection means including an injector body having an upper portion and a lower portion, and having an internal passage means with a first end in the upper portion for receiving pressurized fuel and a second end in the lower portion for passing pressurized fuel from the passage, a solenoid-actuated first valve slideably mounted at the first end of the passage means having a pressure balanced annulus openable between a solenoid-energized position in which high pressure fuel is delivered through the annulus to the passage means, and a solenoid de-energized position in which high pressure fuel is blocked by the annulus from passing to the passage means, a needle valve movable in the injector body to control the flow of pressurized fuel through the second end of the passage means, the needle valve being movable in a first direction toward an open position for passing pressurized fuel through the second end of the passage means when the solenoid-actuated valve is in the solenoid-energized position, and an opposite, second direction toward a closed position for blocking pressurized fuel from passing through the second end of the passage means when the solenoid-actuated valve is in the solenoid de-energized position, a spring cage forming a seat for the needle valve in the injector body adjacent the second end of the passage and biasing the needle valve in the second direction in fluid communication with the passage means, and having an upper balancing chamber and a lower balancing chamber, and a first sized orifice therebetween, and an adjustable pressure balanced second valve slideably mounted on the lower portion of the injector body and having means openable to open the second valve when the solenoid-actuated valve is in the solenoid de-energized position to communicate pressurized fuel into the spring cage to aid the spring cage in biasing the needle valve in the second direction to a closed position to thereby obtain a sharp end of injection, and a second sized orifice in the lower balancing chamber in fluid communication with means to maintain a residual fuel pressure within the spring cage when the solenoid-actuating valve is in the solenoid de-energized position to thereby slow the movement of the needle valve in the first direction toward an open position when the solenoid-actuated valve is next in the solenoid-energized position.

Still further objects and advantages of the invention will become readily apparent to those skilled in the art to which the invention pertains upon reference to the following detailed description.

DESCRIPTION OF THE PREFERRED EMBODIMENTS

Figure 1:
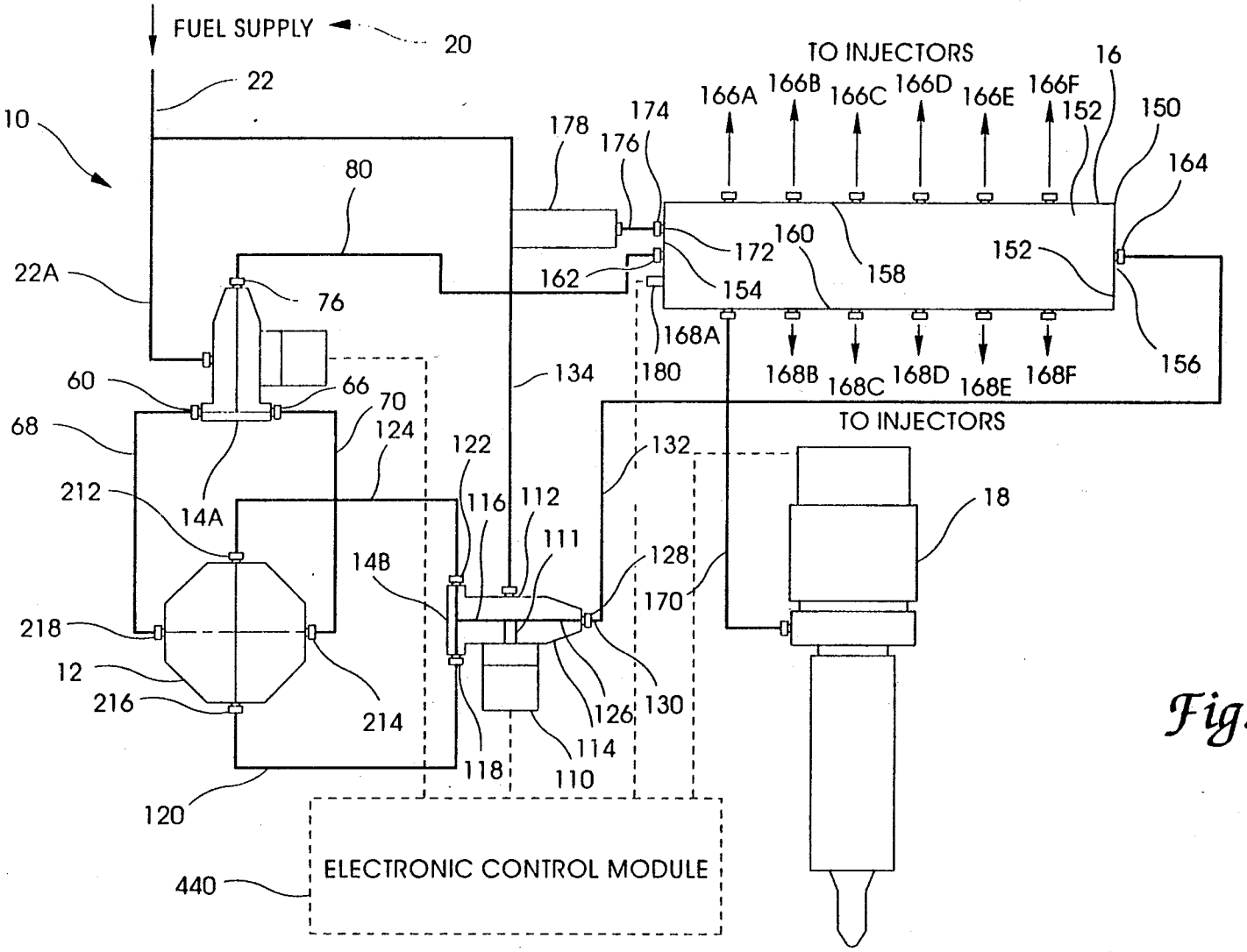
FIG. 1 illustrates a high pressure common rail fuel injection system, illustrating the preferred embodiment of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to the drawings, a preferred fuel injection system 10 comprises an electronic controlled pump means 12, solenoid valve assembly means 14A and 14B, a common rail assembly 16 and electromagnetic injector means 18. Fuel is delivered from a fuel supply 20 through conduit means 22 to solenoid valve assembly means 14A and 14B. The two valve assembly means 14A and 14B are identical in construction, their function differing according to their fluid connection with pump means 12.

Figure 4:
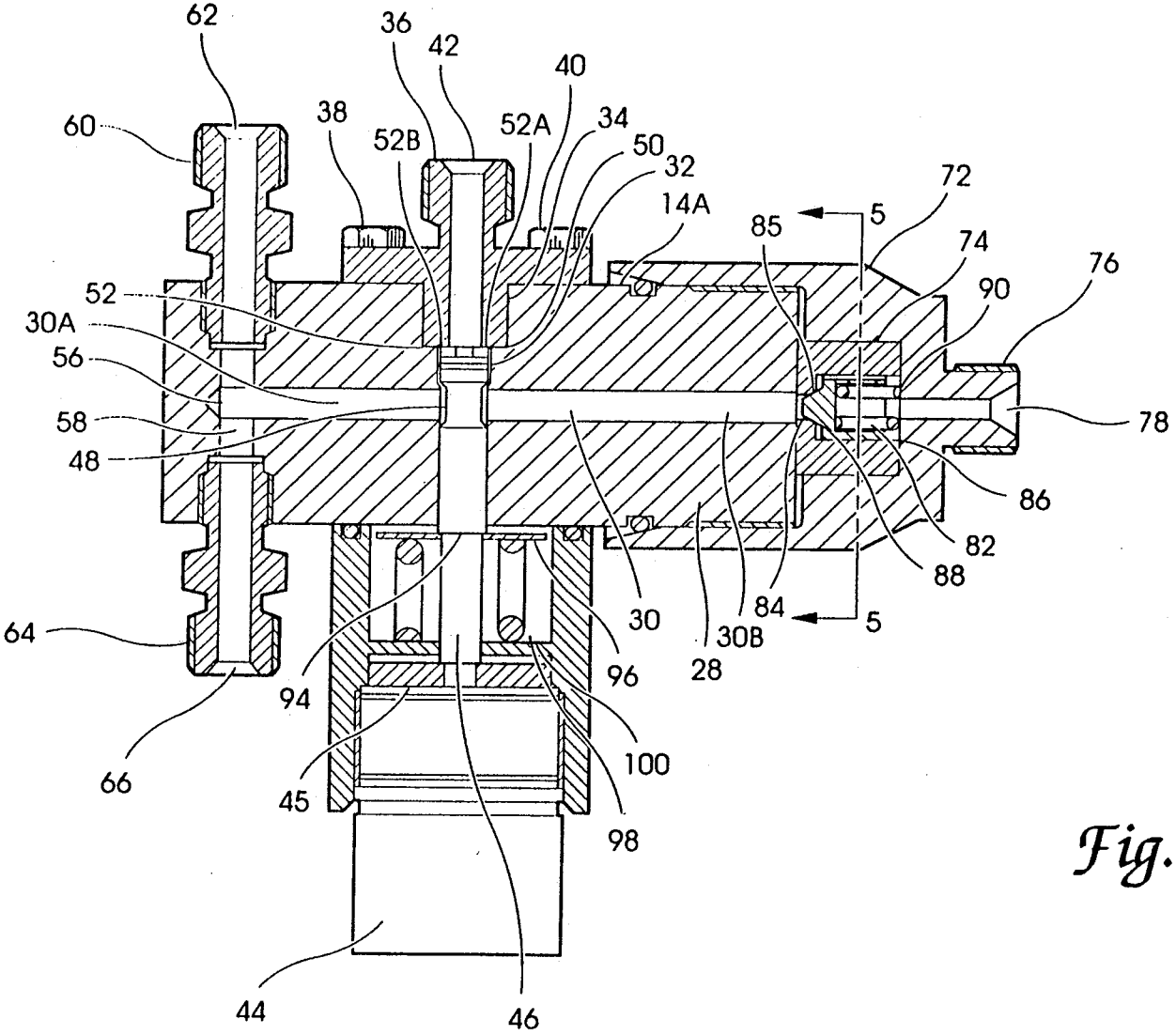
FIG. 4 is a view of a preferred solenoid valve assembly.

Referring now to FIG. 4, solenoid valve means 14A comprises a body 28 having a longitudinal passage 30 including halves 30A and 30B. A transverse passage 32 extends at right angles to passage 30 and intersects passage 30. One end of passage 32 is enlarged at 34. A fuel inlet fitting 36 is mounted in enlarged passage 34. A pair of fasteners 38 and 40 fasten fitting 36 to the body 28. Fitting 36 has a passage 42 for receiving fuel from conduit means 22A (FIG. 1).

Figure 5:
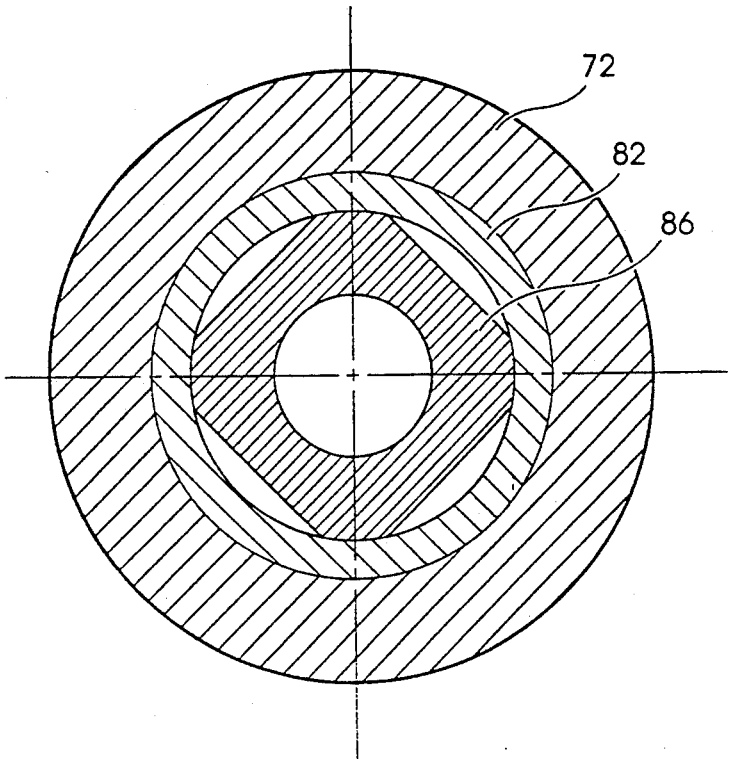
FIG. 5 is a sectional view as seen along lines marked FIG. 5—FIG. 5 on FIG. 4.
Figure 5A:
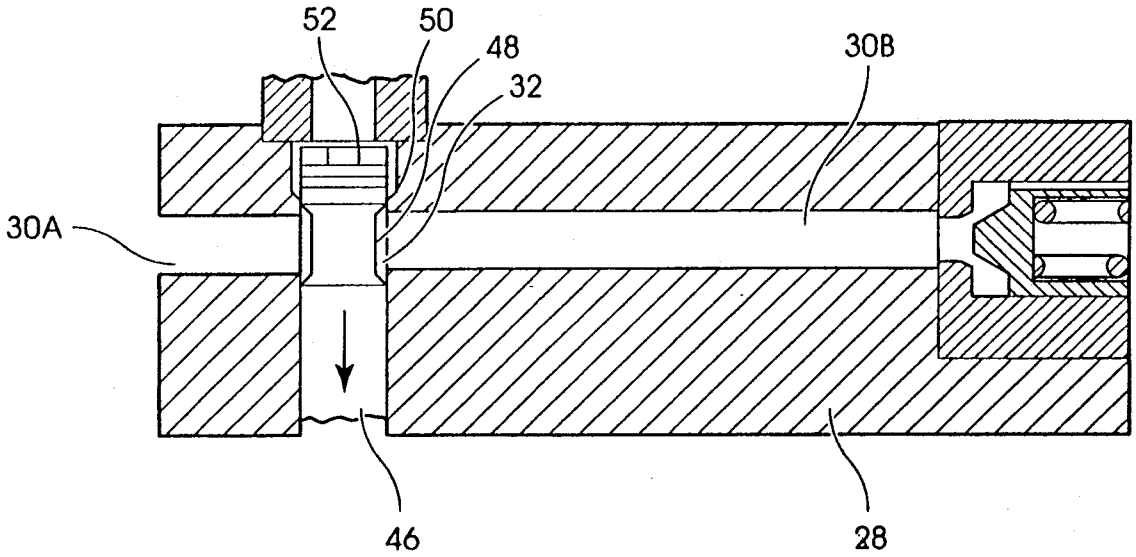
FIG. 5A is an enlarged fragmentary view of the solenoid valve in closed position for delivering fuel to the common rail.
Figure 5B:
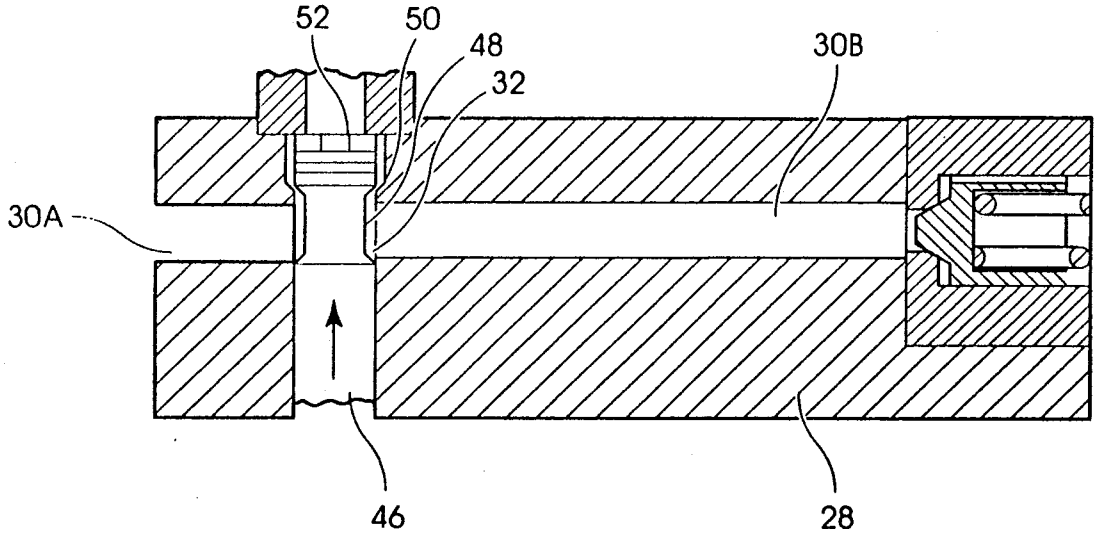
FIG. 5B is an enlarged fragmentary view showing the solenoid valve in open position disposed for bypassing the fuel.

Referring now to FIGS. 4, 5A and 5B, an electromagnetically operated solenoid 44 is mounted on the body 28 and is operatively connected to control valve 46, which is slideably disposed in passage 32 for reciprocatory motion. Valve 46 has an annular groove 48, spaced from the outer end of the valve. The bottom of the enlarged end of the bore 34 is tapered at 50 to provide a seat for outer end 52 of control valve 46.

Solenoid 44 is operated to move the control valve 46 between a closed position (FIG. 5A) in which valve end 52 engages seat 50 to block fluid flow between passages 42 and 32, and an open position (FIG. 5B) in which the control valve 46 abuts fitting 36 to open fluid flow between passage 32 and a pair of passages 52A and 52B in fitting 36 to passage 42. In both positions, there is a fluid connection between the halves 30A and 30B of passage 30.

Referring now to FIG. 4, body 28 has an internal passage 56 forming an extension of passage 30A. The body has a second passage 58 at right angle to and intersecting passage 56. A fitting 60 is mounted on the body 28 and has an internal passage 62 forming an extension of one end of passage 58. A second fitting 64 is mounted on the opposite side and has an internal passage 66 forming an extension of the end of passage 58.

Referring now to FIG. 1, conduit 68 forms a fluid connection between fitting 60 and pump means 12, and another conduit 70 forms a fluid connection between fitting 64 and a pump means 12.

Returning now to FIGS. 1, 4, and 5, a nut 72 is mounted on the opposite end of the body 28. Nut 72 has an internal chamber 74. A threaded fitting 76 is mounted on nut 72. Fitting 76 has a passage 78 connected to a conduit 80 (FIG. 1). A cup-shaped member 82 is mounted in chamber 74. Member 82 has a cylindrical internal wall, and an opening 84 communicating with passage 30B, which forms a valve seat 85 for slideably mounted, hollow check valve 86. Check valve 86 has a conical end 88, which mates with valve seat 85 to close fluid flow from passage 30 into chamber 74. A spring bias member 90 is mounted in the check valve 86 and biases check valve 86 toward its closed position.

Referring now to FIG. 5, check valve 86 has a square cross-section slideably mounted in the cylindrical internal wall member 82 to permit fuel flow from passage 30 into chamber 74 when conical end 88 is spaced from the valve seat 85.

Still referring to FIGS. 1 and 4, when solenoid means 44 is electrically energized, it retracts control valve 46 away from fitting 36 to close fluid flow between passage 32 and passage 42. The control valve 46 has an annular shoulder 94. A washer 96 is mounted on the shoulder A return spring 98 is disposed between the washer 96 and a retainer 100 to bias the control valve 46 toward fitting 36 and the control valve's open position.

In operation, when the control valve 46 is seated in its closed position, fluid flow is blocked between passage 30 and conduit 22A (FIG. 1). When check valve 86 is opened, fuel passes from the pumping means through passages 30A and 30B and out to conduit 80 (FIG. 1). When the control valve 46 is raised to engage fitting 36 in the valve's open position, the fuel Passes from passage 30A and out conduit 22A, when check valve 86 is closed.

Referring now to FIG. 1, the second solenoid assembly 14B is identical in construction to solenoid 14A and includes a solenoid 110 mounted on a body 112. A nut 114 is mounted on one end of the body and has an internal passage 116. One end of passage 116 is connected by fitting 118 and conduit 120 to the pump means 12. The opposite end of internal passage 116 is connected by fitting 122 and conduit 124 to the pump means 12 in a manner which will be described.

The body 112 has an internal passage means 126, one end of which is connected to internal passage 116 and the other end of which terminates with fitting 128. A check valve 130 provides means for opening and closing fuel flow from the body 112 to a conduit 132, which is connected to common rail 16. Fuel is received from fuel supply 20 through a conduit 134.

Solenoid 110 moves control valve 111 to control fluid flow between internal passage means 116 and conduit 134 in the manner that control valve 46 controls flow between passage 30 and conduit 22A. Fuel is discharged from conduits 80 and 132 to common rail 16.

Figure 6:
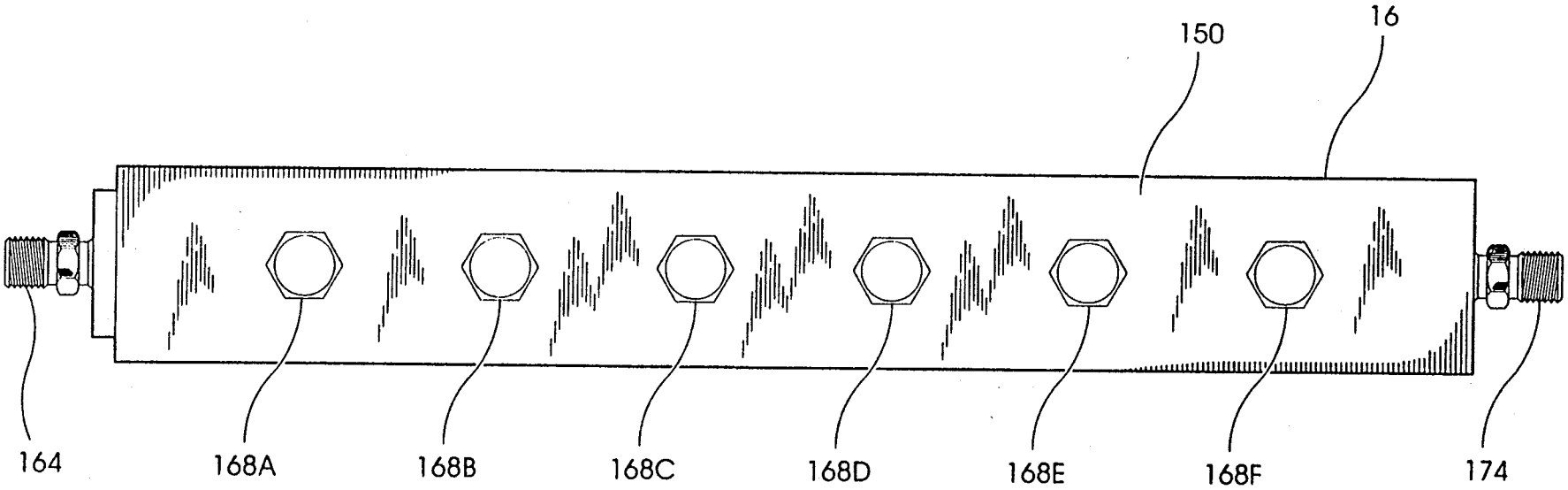
FIG. 6 is a side view of the preferred common rail of FIG. 1.
Figure 6A:
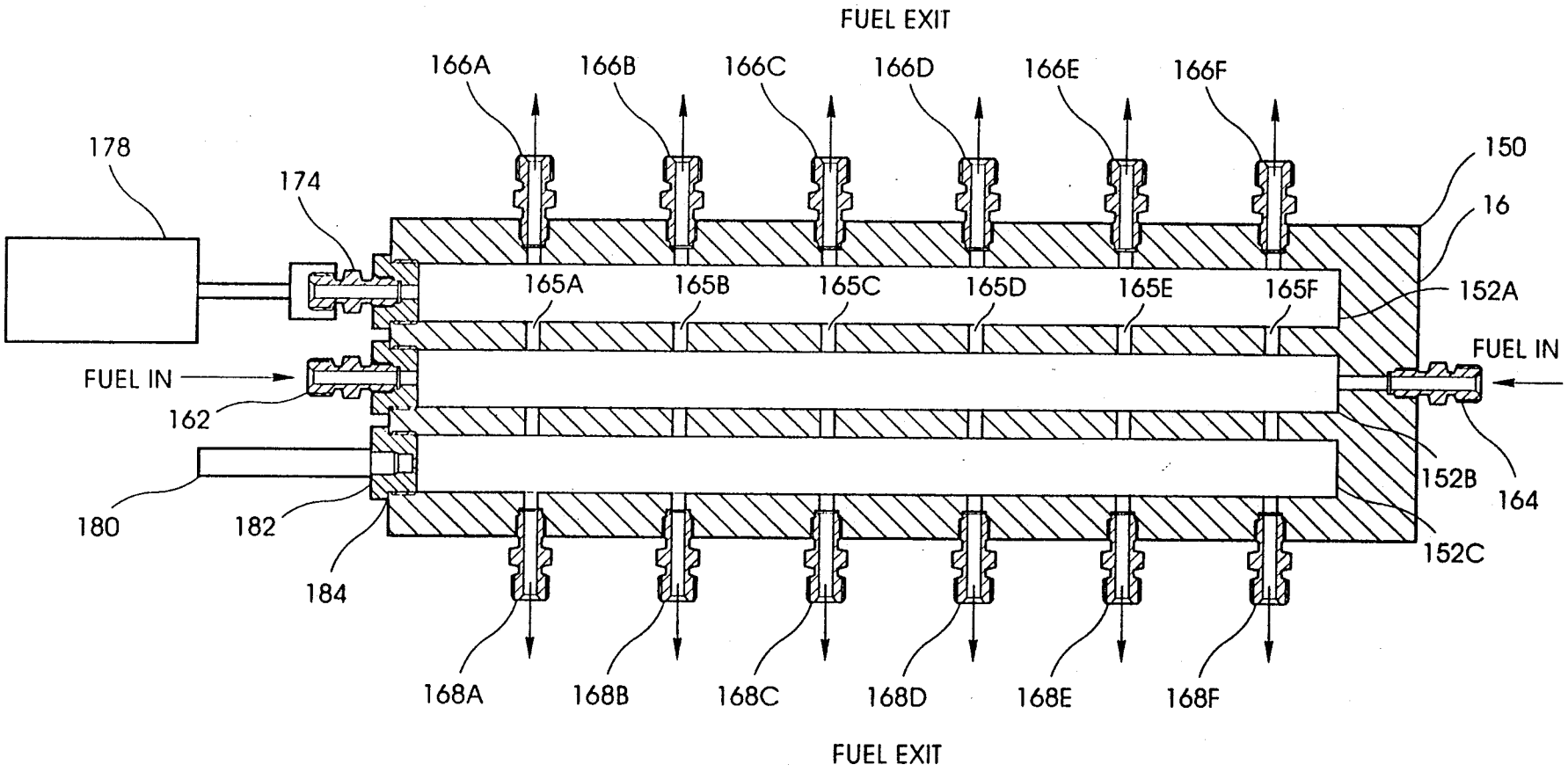
FIG. 6A is a cross-sectional view of preferred common rail with one central passage and two side passages.

Referring now to FIG. 1, 6 and 6A, common rail 16 has a relatively flat metal body 150. Body 150 has a central chamber 152B and side chambers 152A and 152C. Body 150 has a rectangular cross-section bounded by end walls 154 and 156, and side walls 158 and 160. End walls 154 and 156 have a pair of inlet fittings 162 and 164. Inlet fitting 162 is connected to conduit 80 for receiving fuel from solenoid valve assembly 14A into the common rail central chamber 152B. Fitting 164 is adapted to receive fuel from the solenoid valve assembly 14B through conduit 132 into the central chamber 152B. Side wall 158 has fuel discharge fittings 166A through 166F. The opposite side wall 160 has fuel discharge fittings 168A through 168F.

The side chambers 152A and 152C communicate with central chamber 152B through cross-drilled holes 165A through 165F. The cross-drilled holes 165A through 165F create a constant pressure and a perfect pressure distribution in the side chambers and eliminate the pressure fluctuations which occur in the central passage because of the pumping strokes and reflected pressure waves.

The number of fuel discharge fittings 165, 166, 168, or the number of cross-drilled holes can vary depending on the engine application. For example, for a six cylinder engine, the common rail 16 will have only twelve discharge fittings and six cross-drilled holes (for an arrangement like that illustrated in FIG. 6A) or six fittings and six cross-drilled holes (for an arrangement like that illustrated in FIG. 6B).

Each of the fuel discharge fittings 166A through 166F, and 168A through 168F is connected by a conduit, such as conduit 170, to an electromagnetic injector typified by injector means 18.

End wall 154 has an outlet 172. A fitting 174 is mounted in the outlet opening and connected by a conduit 176 to an adjustable relief valve 178. The adjustable relief valve 178 is adapted to protect and relieve the pressure in chamber 152A when it exceeds a maximum predetermined pressure level.

A pressure transducer 180 is also mounted in the end wall 154, and is connected to the Electronic Control Module 440, monitoring the pressure in chamber 152C.

Figure 3:
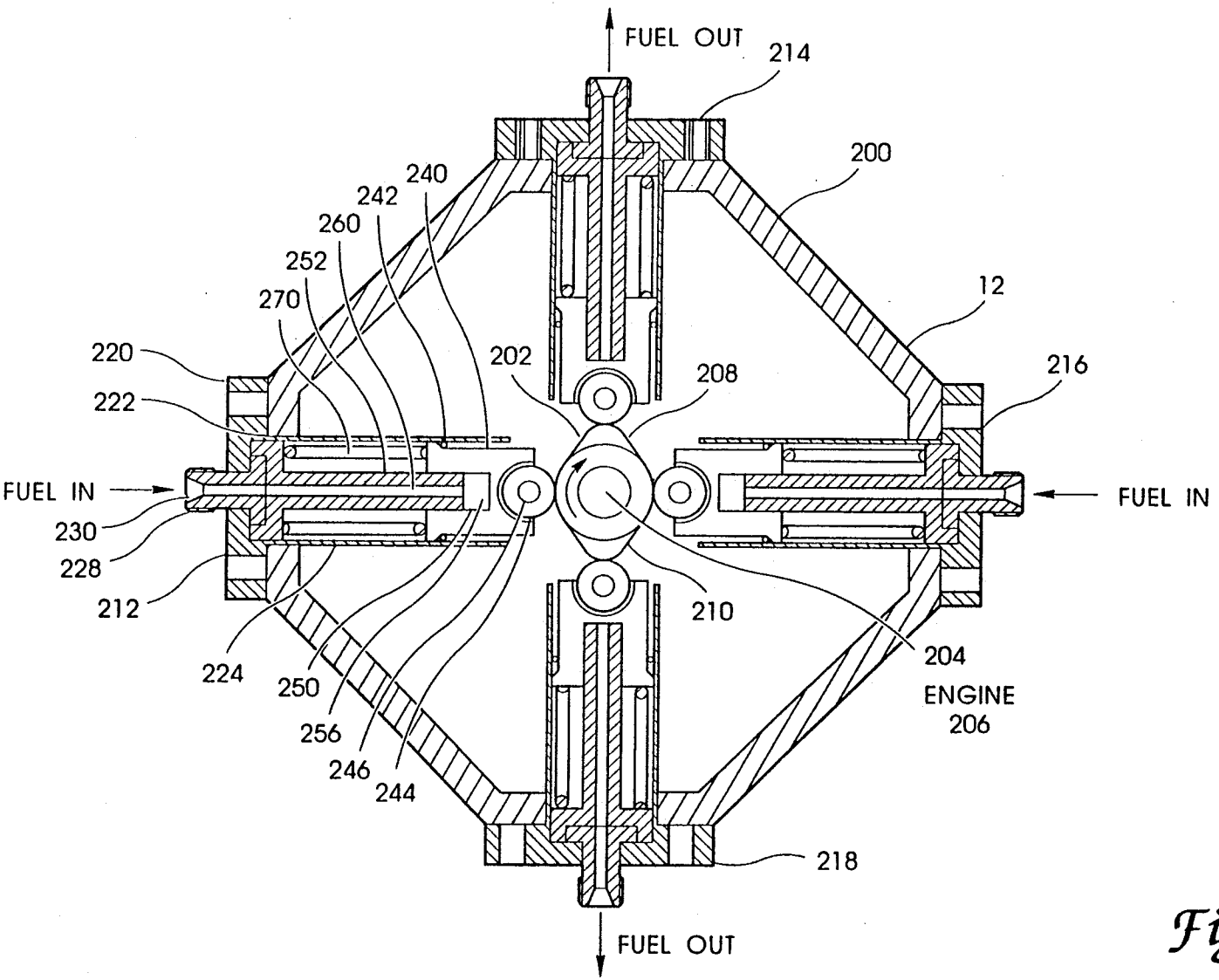
FIG. 3 is a view of an electronically-actuated pump assembly illustrating the preferred fuel pump.

Referring now to FIGS. 1 and 3, fuel pump means 12 comprises a housing 200. A camshaft 202 is mounted in the housing and is connected by mechanical connection 204 to the engine 206. The camshaft 202 has two identical lobes 208 and 210 mounted 180 degrees apart. Four identically constructed pumping means 212, 214, 216, and 218 are mounted in the housing, spaced 90 degrees with respect to one another about the axis of rotation of the camshaft. Pumping means 212 is typical of the four and includes a mounting flange 220 disposed in an opening 222 in the pump housing 200. The flange 220 carries a cylindrical skirt 224 and supports a fitting 228 having an internal passage 230.

A tappet bushing 240 is mounted in the skirt 224. A retainer ring 242 is carried by the bushing 240 and is slideably mounted on the inner surface of skirt 224.

A tappet roller 244 is rotatably mounted on a pin 246 carried by the bushing 240. The roller 244 is rotatably engaged with the camshaft 202 such that the tappet bushing 240 is movable within the skirt 224 depending upon the position of the camshaft 202.

The bushing 240 has an internal bore 250. A plunger 252 is slideably mounted within the bore 250 to form a pumping chamber 256, which expands and contracts depending upon the position of the tappet roller 244 on the camshaft 202. The plunger 252 has an internal passage 260 for passing fuel toward or away from pumping chamber 256. The arrangement is such that as the tappet roller 244 rides up on either camshaft lobe 208 or lobe 210, the bushing 240 moves toward the plunger 252 to reduce the size of pumping chamber 256, thereby delivering fuel under pressure through passage 230. As the camshaft 202 is rotated so the tappet roller 244 is riding on the back side of either camshaft lobe, a spring bias member 270 having one end engaged with the plunger 252 and its other end engaged with the bushing 240, urges the bushing toward the camshaft 202 to enlarge chamber 256. As pumping chamber 256 is enlarged, the chamber creates a low pressure area, drawing fuel into the chamber through the passage 260 in the plunger 252.

Thus, it can be seen that as the camshaft 202 is rotated, it simultaneously pumps fuel out of the pumping chambers of pumping means 214 and 218, while drawing fuel into the pumping chambers of pumping means 212 and 216. As the camshaft 202 continues its rotation, the fuel is drawn into the pumping chambers of pumping means 214 and 218, and pumped out of the pumping chambers of pumping means 212 and 216. This provides a pumping action having a balanced motion of the pumping components and eliminating the bending stresses on the camshaft 202.

Referring now to FIG. 1, pumping means 212 and 216 are connected by conduits 124 and 120, respectively, to solenoid assembly 14B. Similarly, pumping means 214 and 218 are connected by conduits 70 and 68, respectively, to solenoid assembly 14A. The pumping means 212, 216, 214 and 218 either pump fuel toward the common rail 16 or recirculate fuel to the fuel supply conduits depending upon whether the control valves 46 and 111 in the solenoid valve assemblies 44 and 110 are open or closed.

The solenoids on the solenoid valve assemblies 44 and 110 are energized or de-energized and are controlled by the Electronic Control Module 440, which is monitoring the pressure in the common rail 16 through pressure transducer 180. This way, the pressure in the common rail 16 can be preset for every engine speed by setting the right parameters for the Electronic Control Module.

Referring now to FIGS. 7, 7A, 7B, 7C, 7D and 7E, a typical electromagnetic injector 18 comprises a body 300 having a nut 302 threadably mounted at its upper end, and a retaining cap 304 mounted at its lower end. An electromagnetically actuated solenoid 306 is mounted on the nut 302. The solenoid 306 has an armature 308 disposed in a chamber 310 and is sealed to nut 302 by means of an "O" ring 312.

The armature 308 of the solenoid 306 is connected to an elongated valve 314, which extends through a chamber 316 in the nut. Valve 314 is slideably mounted in bore 318 in the body 300. The valve has a longitudinal internal passage 320 and a cross passage 322 has its ends communicating with chamber 316 (FIG. 7E), which in turn communicates with passage 324 in fitting 326.

Figure 7:
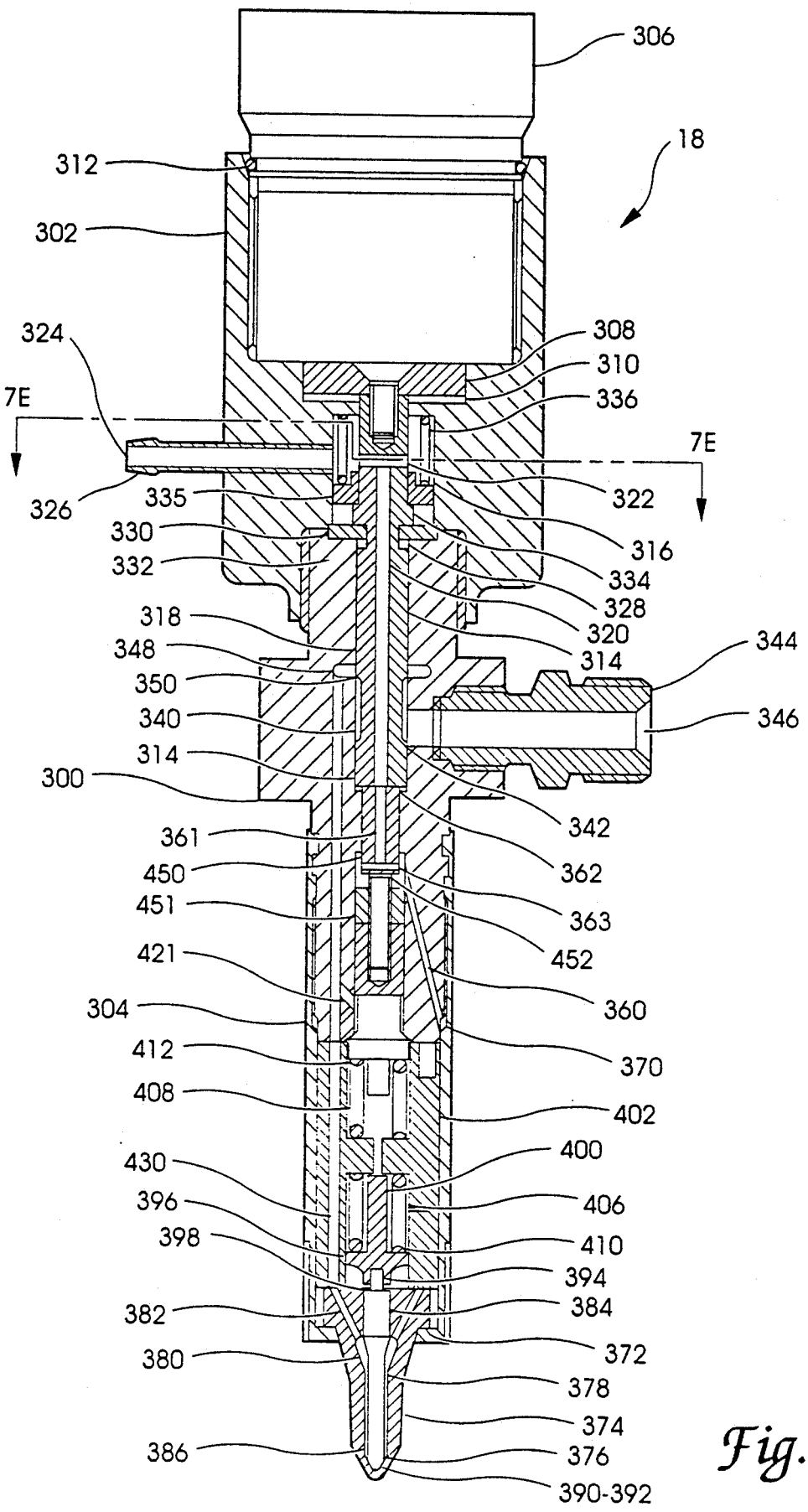
FIG. 7 is a longitudinal sectional view of a preferred electromagnetic injector.
Figure 7A:
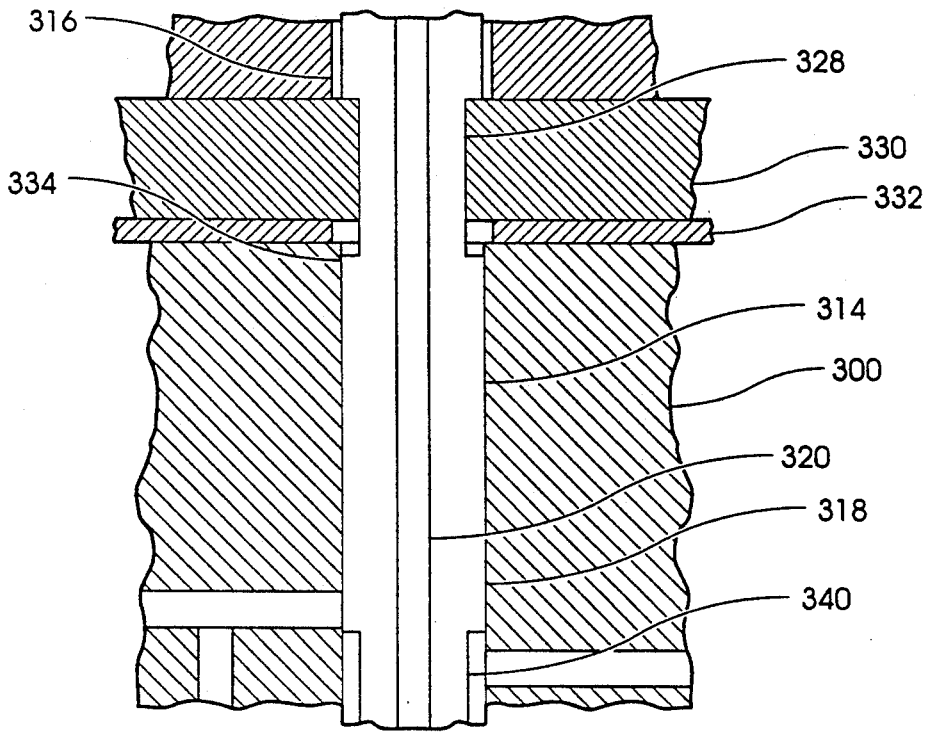
FIGS. 7A and 7B are an enlarged sectional views showing the inlet opening and closing of the injection fuel delivery passage by the injectors solenoid valve.
Figure 7B:
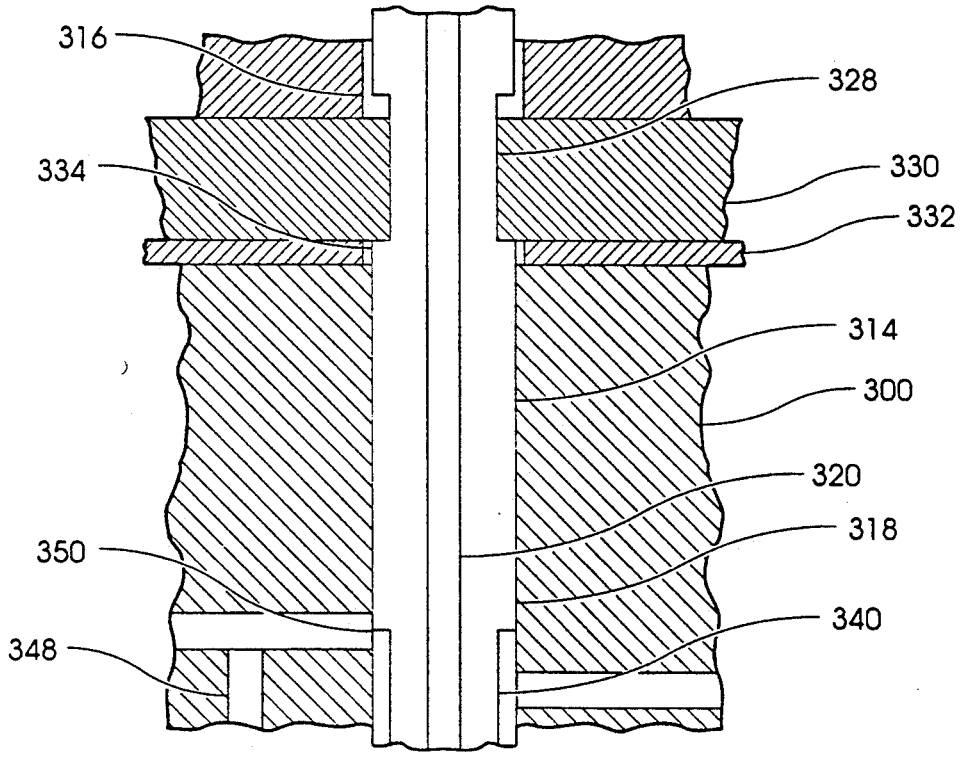

Referring now to FIGS. 7A and 7B, valve 314 has an annular groove 328. An annular retaining plate 330 is mounted in the groove and has a thickness less than the width of the groove. Shims 332 are mounted adjacent the retaining plate.

The retaining plate thickness is used to adjust the travel of the valve 314 by allowing the valve to move only as far as the ends of the groove and the retaining plate thickness allows. FIG. 7A illustrates the valve 314 in its lowest position in abutment with retaining plate 330, while FIG. 7B shows the valve in its upper position in abutment with the lower edge of retaining plate 330.

Valve 314 has an annular shoulder 334 disposed in chamber 316. A return spring 336 (FIG. 7) is mounted in the chamber with one end in abutment with nut 302, and the other end in abutment with spring seat 335, seating on shoulder 334 to bias valve 314 toward the retaining cap 304.

The valve 314 has an annular passage 340 adjacent its lower end. The body 300 has an internal passage 342 in communication with passage 340. A threaded fitting 344 is mounted on the body 300 with an inlet passage 36 in communication with passage 342. Passage 342 is connected through conduit 170 (FIG. 1) for receiving fuel from the common rail 16.

The body 300 also has a delivery passage 348 with an inlet opening 350 terminating at bore 318. The location of opening 350 is such that when valve 314 is in its lowermost position, the valve blocks fluid through opening 350. When the valve 314 is in its upper position, it opens a fluid connection between annular passage 340 and inlet opening 350.

Referring now to FIG. 7, the body 300 also has a passage 360 and with passage 361 and 363 connects the bottom of the body 300 to bore 318. A small chamber 362 is defined between the lower, extreme end of the valve 314 and the bottom of bore 318 to provide room for the valve motion and for fluid communicating between passage 320 and chamber 370 through passages 360, 361 and 363.

Retaining cap 304 has a large internal chamber 370. Chamber 370 has a bottom opening 372. An elongated spray tip 374 is disposed in the chamber 370 with its lower end extending through opening 372. The outer end of the spray tip has opening means 376 for passing fuel to the engine cylinder (not shown).

The spray tip 374 has an elongated, slightly tapered passage 378. The lower end of the passage 378 passes fuel to opening means 376. The upper end of passage 378 is enlarged at 380 and is fluidly connected to a passage 382 in the spray tip 374. Enlarged section 380 is tapered and terminates with a cylindrical bore 384, which extends through the upper end of the spray tip 374.

A needle valve 386 is mounted in passage 378. The lower end of the needle valve 386 is tapered at 390 to seat against a tapered seat 392 in the spray tip 374 for opening or closing fuel flow through passage means 376. The upper end of the needle valve 386 has a narrowed end 394. A spring seat 396 has a bore 398 receiving the narrowed end 394 of the needle valve 386. Spring seat 396 is movable in chamber 406 to define the travel of the needle valve 386 between its open and closed positions. The spring seat 396 has a raised midsection 400 to limit the needle valve travel.

Figure 7C:
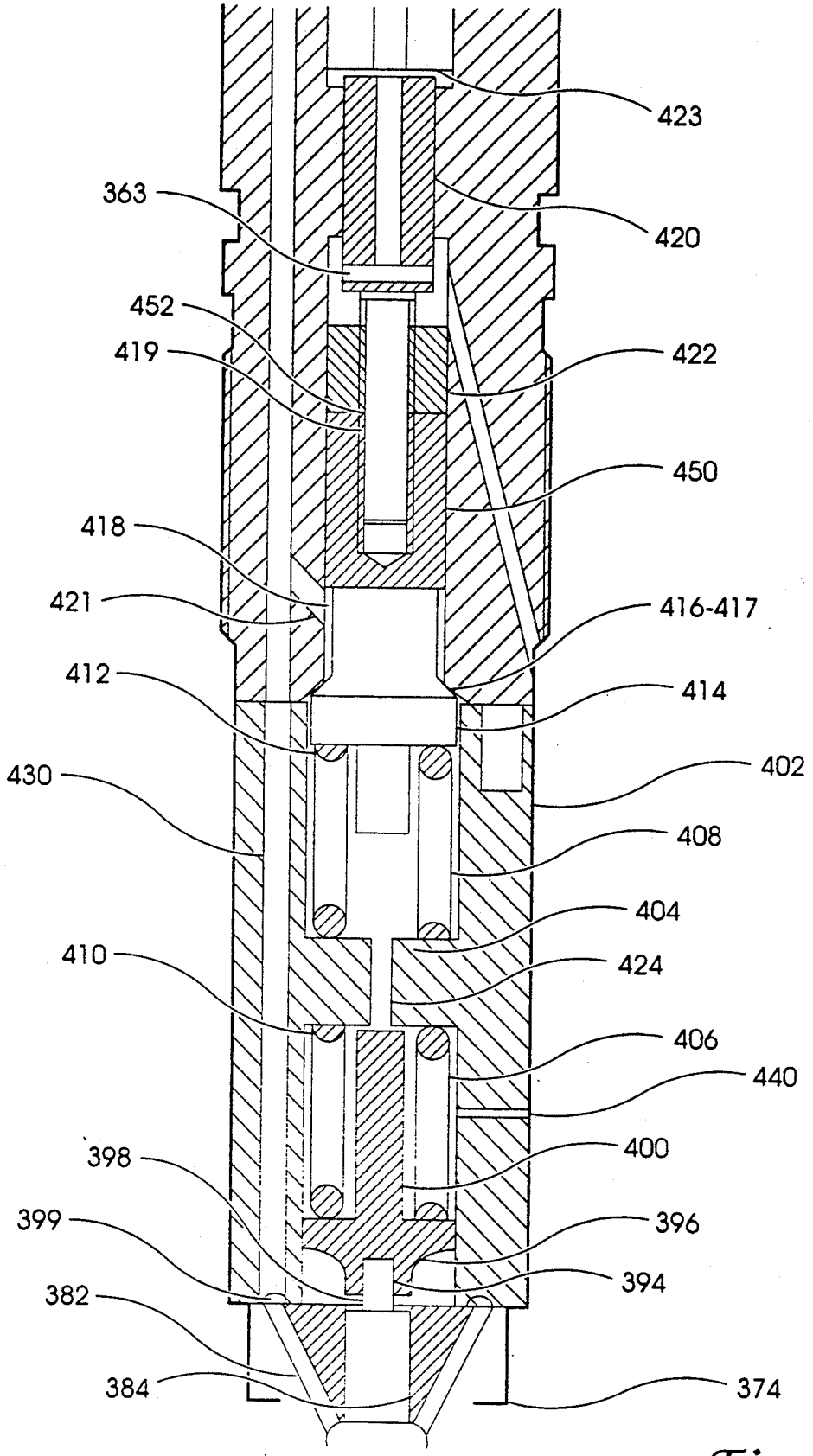
FIGS. 7C and 7D are views of the opening and closing of the fuel passage to the balancing chamber.
Figure 7D:
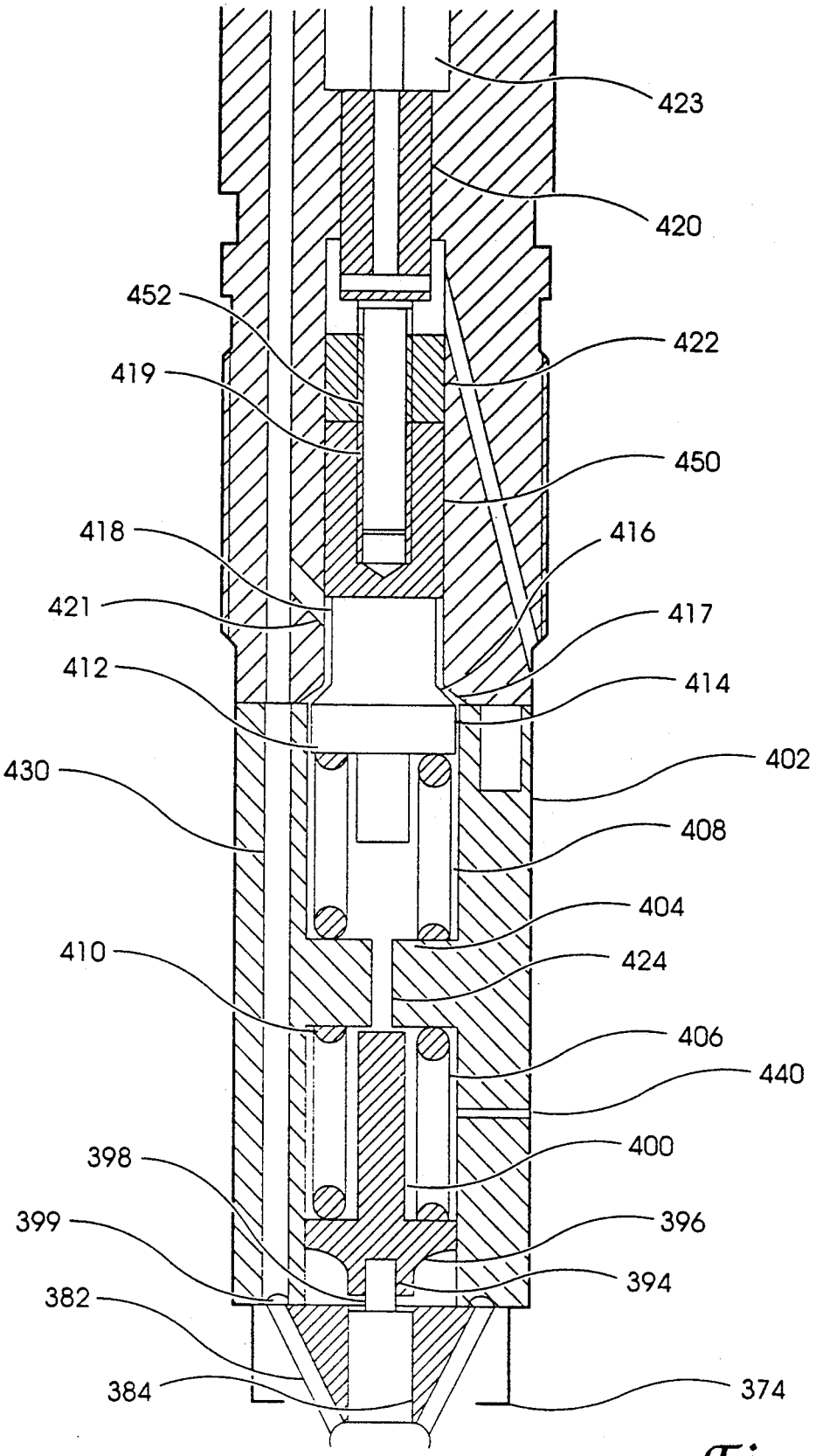
Figure 7E:
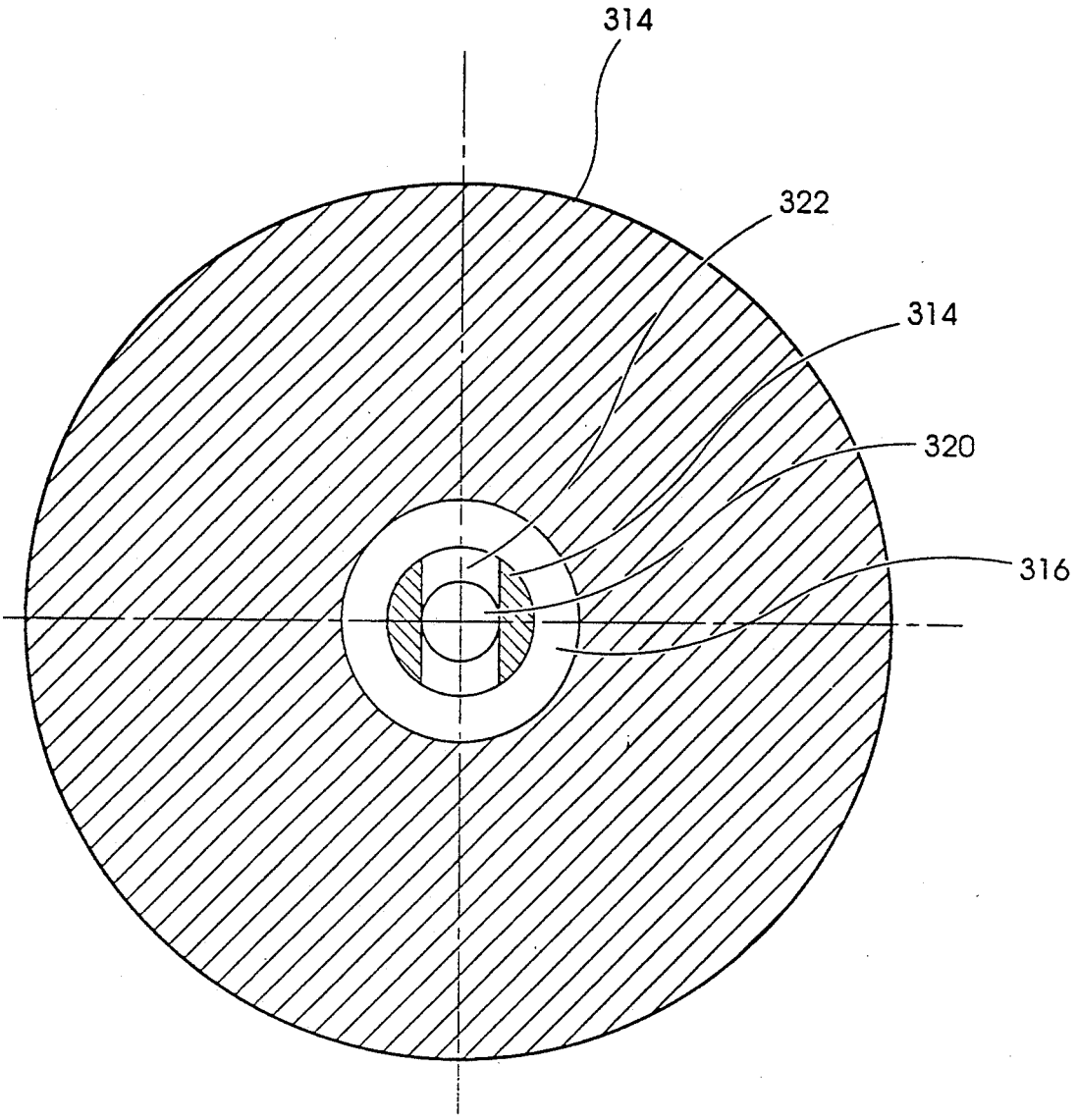
FIG. 7E is an enlarged view along lines 7E—7E of FIG. 7.

Referring now to FIGS. 7, 7C and 7D, spring cage 402 is mounted in chamber 370. The cage 402 has wall 404 separating a lower balancing chamber 406, and an upper balancing chamber 408. A coil spring 410 in the lower chamber has its upper end engaging wall 404, and its lower end engaging spring seat 396 to urge spring seat 396 and the needle valve 386 toward the needle valve's closed position. A coil spring 412 in the upper chamber has its lower end engaged with wall 404. A valve 414 is mounted in the upper chamber and engages the upper end of spring 412. Valve 414 has an annular section 418 and a tapered portion 416 seating on seat 417 of injector body 300. The upper portion of valve 414, is engaging bore 450 in body 300 and has an inside threaded portion 452.

A piston-screw 420 is engaging valve 414 through a threaded portion 419, on the lower end, and has a securing nut 422 which secures its adjusted height to valve 414. The piston-screw 420 is adjusted such that it maintains a preset clearance 423 to the lower end of valve 314 when the valve is lifted to its upper position by energizing the solenoid 306. When solenoid 306 is de-energized, valve 314 is lowered by spring 336 and pushes downwards piston-screw 420 and valve 414 unseating valve seat 416 from seat 417 allowing fuel from passage 430 and 421 to enter chamber 408 and chamber 406, through orifice 424.

Spring cage 402 has a passage 430 communicating on the upper end with passage 348, and on the lower end with passage 382 from spray tip 374. The spring cage 402 also has a lateral orifice 440, which extends from lower chamber 406 to outside spring cage 402, communicating with chamber 370 along the inside wall of retainer cap 304.

Referring now to FIG. 1, during engine operation, the fuel from supply 20, such as a fuel tank, is delivered at a predetermined pressure by a supply pump (not shown) to an electronically controlled pump means 12 through solenoid valve assembly means 14A and 14B. Each opposed pair of pumping means 212, 214, 216 and 218 of the pump means 12 draw the fuel into their pumping chambers as the camshaft 202 is turned, and then pump the fuel back to the corresponding solenoid valve assembly 14A or 14B.

The fuel from the pumping elements 212, 214, 216 and 218 passes through the solenoid valve assemblies 14A and 14B and is recycled to the fuel supply 20 depending upon the position of the solenoid control valves 46 and 111. For example, when the solenoid valve assembly 14A is energized by a signal with a certain pulse coming from the Electronic Control Module 440, the solenoid armature 45 (FIG. 4) pulls the control valve 46 to its closed position, and the fuel coming from the pumping elements through passage 30 opens check valve 86 (FIG. 4) to pass fuel through fitting 76 toward the common rail 16.

The two solenoid valve assemblies 14A and 14B are alternatively energized, having been correlated to the timing of the opposed pumping elements.

The pumping process ends when the solenoids of the solenoid valve assemblies 14A and 14B are de-energized, and, for example, the control valve 46 forced by springs 98 opens tapered seat 50 and allows fuel passing 30A to pass into passage 42 and return to fuel tank, causing a pressure drop in passage 30B, which will cause spring 90 to seat valve 86, disconnecting the fuel flow from the pump to the common rail.

The fuel coming from the solenoid valve assemblies enters into the common rail central passage 152B through either fitting 162 or 164, depending upon which solenoid valve assembly is in the pumping mode. The fuel is accumulated in the common rail at a predetermined pressure adjusted according to Electronic Control Module 440 commands. The Electronic Control Module 440 monitors the common rail pressure with a Pressure transducer 180 and according to the its preset input data, will adjust the signal to the solenoid valve assemblies to achieve the necessary common rail pressure.

The high pressure fuel from the common rail's central passage passes through cross-drilled passages 165A through 165F into side passages 152A and 152C. The cross-drilled orifices will restrict the pumping stroke effect and fuel wave reflects and the side passages will have a constant high pressure all along the side passages, insuring an equal fuel and pressure distribution to all electromagnetic injectors through their corresponding outlet fitting. This common rail construction illustrated in FIG. 6A is used on diesel engines having their cylinders arranged in "V" configuration. The number of cross-drilled passages is equal to half of the number of the side fuel exit fittings.

Figure 6B:
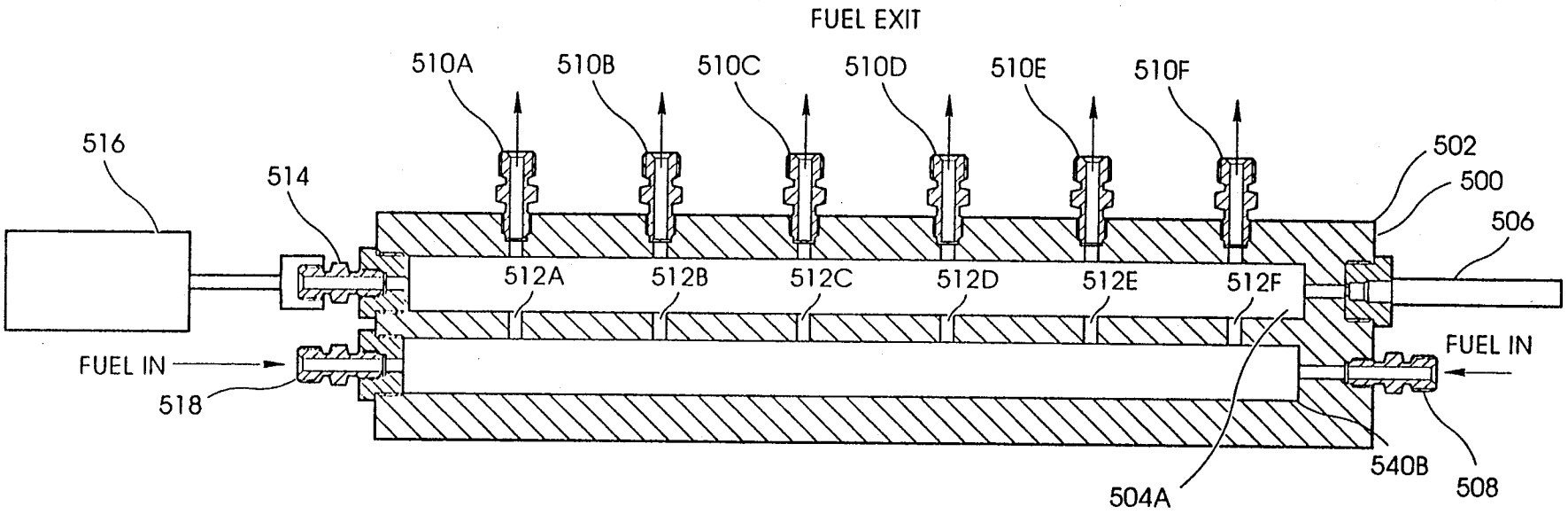
FIG. 6B is a cross-sectional view of a common rail with one central passage and one side passage.

FIG. 6B illustrates a common rail with one central passage 504B and only one side passage 504A, used for diesel engines having an "in line" cylinder arrangement. The fuel enters the rail through fittings 508 and 518 mounted on the opposite sides of the central passage 504B. The side passage 504A has a pressure transducer 506 mounted at one end and relief valve 516 mounted at the other end. The number of cross-drilled passages 512A through 512F is equal to the number of side fuel exit fittings.

The number of common rail fuel exit fittings can change according to the number of diesel engine cylinders were this system is applied.

The fuel from the common rail is delivered to each of the electromagnetic injectors, entering the injector body through fitting 344. The fuel flow stops at injectors solenoid valve annular passage 340 having opening 350 normally closed. When solenoid 306 is energized with a signal coming from the Electronic Control Module 440, the armature 308 and valve 314 are lifted, opening fuel flow through opening 350, passages 348, 421, 430, 382 and 378. The solenoid valve is pressure-balanced by the upper and lower sides of annular passage 340.

The pressurized fuel continues downward to the spray tip 374. The fuel pressure acts against the tapered section of the needle valve 386. The fuel pressure lifts the needle valve and permits the pressurized fuel to spray into the engine's combustion chamber through spray opening means 376.

With solenoid 306 energized and valve 314 lifted, piston 420 is adjusted such that it maintains a small gap 423 to valve 314 on its upper end allowing valve 414 to seat with its tapered seat 416 on the body's tapered seat 417, stopping fuel from entering passage 412 and annular passage 418 to enter the spring cage's upper chamber 408.

The injection process ends when solenoid 306 is de-energized, solenoid valve 314 is moved downwards by spring 336 and it closes opening 350. The fuel bleeding through spray holes 376 will cause a fuel pressure drop in chamber 378 and section 380, allowing spring 410 to seat needle valve 386 on seat 392, closing off fuel bleeding through spray holes 376 (FIG. 7).

At the same time, when solenoid valve 314 is lowered, the lower end of the solenoid valve eliminates gap 423 and pushes open valve 414, allowing pressurized fuel from passage 421 and annular section 418 to pass through to chamber 408. Pressurized fuel will continue through a pre-sized orifice 424 into chamber 406 on the top of seat 396, helping spring 410 to close the needle valve earlier and providing a sharp end of injection. The pre-sized orifice 424 will determine how much pressure assistance will be applied on the top of the seat 396, helping to close the needle valve.

The pressure in chamber 406 is maintained to a certain level by sizing the bleeding orifice 440 on the side wall of the chamber 406. This residual pressure is necessary to slow the needle valve opening on the next injection according to the engine requirements.

Figure 2:
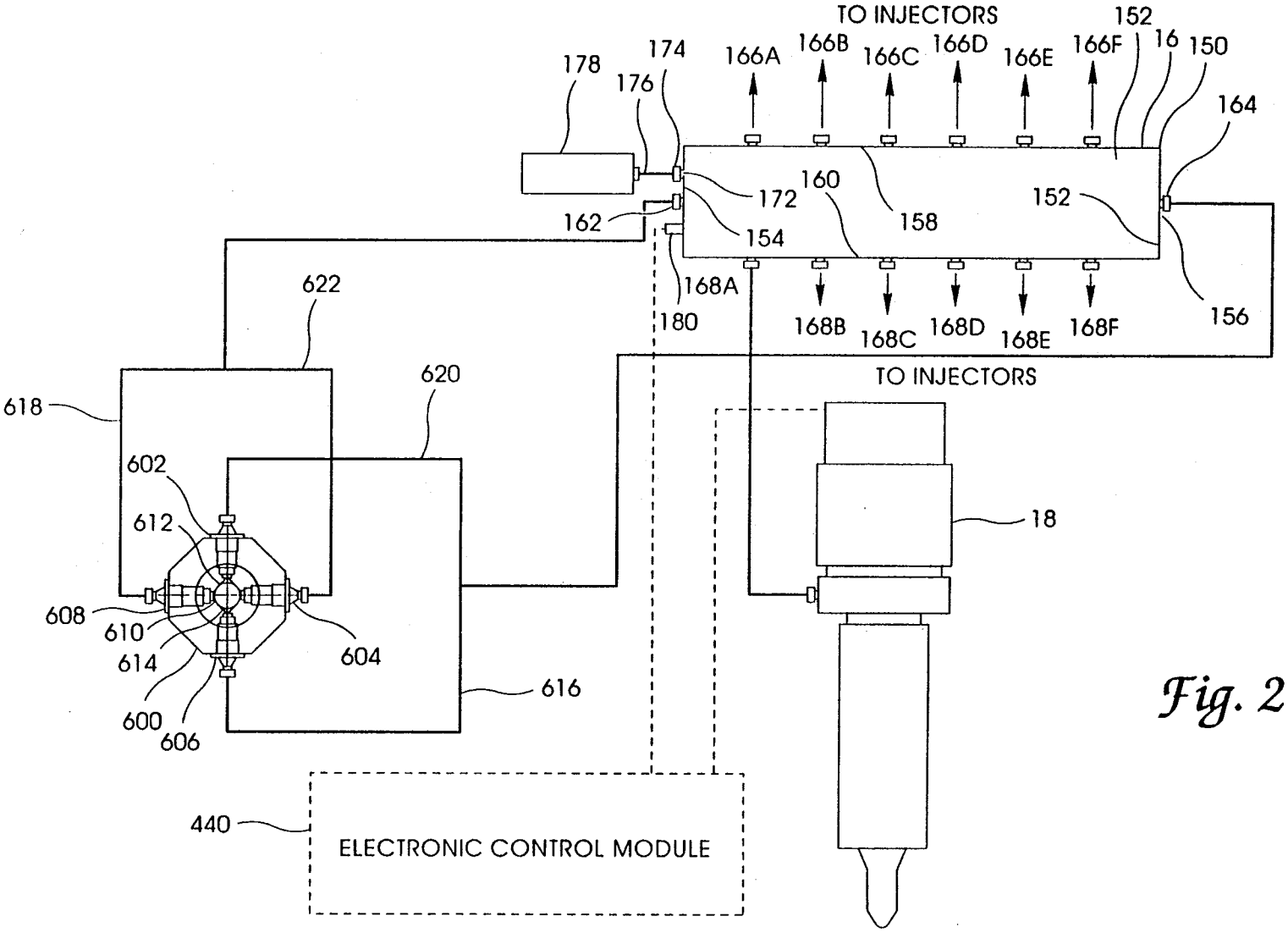
FIG. 2 illustrates a high pressure, common rail fuel injection system with a mechanical pump assembly.

FIG. 2 illustrates a mechanical pump assembly 600 using four standard plunger-operated, one-cylinder pumps 602, 604, 606 and 608, each having fuel metering and timing adjusted by the plunger's helix. The plungers are energized in pairs by a camshaft 610 having a pair of opposed cam lobes 612 and 614. The pumps alternate in pairs in delivering fuel to common rail 16 through conduits 616, 618, 620 and 622 in a manner similar to the embodiment of FIG. 1.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A high pressure, common rail, fuel injection system for injecting metered amounts of highly pressurized fuel into the cylinder of a diesel engine, comprising:

a first body adapted to receive fuel from a source;

a rotatable camshaft supported in the first body so as to be rotatable about an axis, and having a pair of cam lobes including a first cam lobe and a second cam lobe disposed 180 degrees apart and adapted to rotate in an annular path about the axis of rotation of the camshaft;

at least one pair of reciprocating pumping elements mounted in the first body perpendicular to the axis of rotation of the camshaft, each of said pumping elements including an elongated plunger having an axial passage, including a first end and a second end, the first end being connected to a source of liquid fuel, a structure slideably mounted on the plunger so as to form an expandable chamber at the second end of the axial passage, and being movable either to enlarge or reduce the volume of the chamber depending upon the direction of relative motion of said structure and said plunger, tappet means connecting the camshaft to said structure such that as said chamber is being enlarged in volume, fuel is received therein, and as said chamber is being reduced in volume, fuel is discharged therefrom;

means for fluidly connecting the pumping elements to common rail means for passing fuel under pressure thereto in response to rotation of said camshaft;

the common rail means including a second body having a longitudinal central chamber adapted to receive fuel under pressure from said first body and one or more side chambers adapted to discharge fuel under pressure;

cross-drilled passage means connecting said central chamber with said side chambers to eliminate the pumping stroke effect and the wave reflection effect in fuel under pressure and to provide a constant pressure and fuel distribution in fuel discharged from said side chambers;

means for fluidly connecting the common rail means to fuel injection means for passing fuel under pressure thereto in response to rotation of said camshaft;

the fuel injection means including an injector body having an upper portion and a lower portion, and having an internal passage means with a first end in said upper portion for receiving pressurized fuel and a second end in said lower portion for passing pressurized fuel from the passage;

a solenoid-actuated first valve slideably mounted at the first end of said passage means having a pressure balanced annulus openable between a solenoid-energized position in which high pressure fuel is delivered through said annulus to said passage means, and a solenoid de-energized position in which high pressure fuel is blocked by said annulus from passing to said passage means;

a needle valve movable in the injector body to control the flow of pressurized fuel through the second end of said passage means, said needle valve being movable in a first direction toward an open position for passing pressurized fuel through the second end of said passage means when said solenoid-actuated valve is in said solenoid-energized position, and an opposite, second direction toward a closed position for blocking pressurized fuel from passing through the second end of said passage means when said solenoid-actuated valve is in said solenoid de-energized position;

a spring cage forming a seat for said needle valve in the injector body adjacent the second end of said passage and biasing said needle valve in said second direction in fluid communication with said passage means, and having an upper balancing chamber and a lower balancing chamber, and a first sized orifice therebetween; and an adjustable pressure balanced second valve slideably mounted on said lower portion of said injector body and having means openable to open said second valve when said solenoid-actuated valve is in said solenoid de-energized position to communicate pressurized fuel into said spring cage to aid the spring cage in biasing said needle valve in said second direction to a closed position to thereby obtain a sharp end of injection; and a second sized orifice in said lower balancing chamber in fluid communication with means to maintain a residual fuel pressure within said spring cage when said solenoid-actuating valve is in said solenoid de-energized position to thereby slow the movement of said needle valve in said first direction toward an open position when said solenoid-actuated valve is next in said solenoid-energized position.

2. A high pressure common rail for use in a diesel fuel injection system comprising:

a body having a longitudinal central chamber adapted to receive fuel under pressure along its longitudinal axis and one or more side chambers having adaptions to discharge fuel under pressure through fuel injectors; and cross-drilled passage means perpendicular to said longitudinal axis of said central chamber that directly connect said central chamber with said one or more side chambers and that are axially aligned with said adaptions in said one or more side chambers to discharge fuel under pressure to eliminate the pumping stroke effect and the wave reflection effect in fuel entering said central chamber under pressure and to thereby provide a constant pressure in and fuel distribution into said one or more side chambers in the absence of a separate fuel pressure regulator.

3. A common rail as defined in claim 2, in which each of said chambers has a rectangular shape.

4. A common rail as defined in claim 2 in which pressurized fuel is received into said central chamber from a first direction and is discharged from one or more of side chambers in a second direction that is at right angles to said first direction.

5. A common rail as defined in claim 2, in which there is a central chamber and one side chamber on either side thereof.

6. A common rail as defined in claim 2, and further comprising pressure adjustment means mounted on said common rail for monitoring pressure within said common rail and for maintaining a desired pressure therein.

7. A common rail as defined in claim 2, in which said cross-drilled passage means includes cross-drilled orifices adjacent to every adaption of said side chambers to discharge fuel under pressure.

8. A common rail as defined in claim 7, in which there is a central chamber and one side chamber on either side thereof, and the number of cross-drilled orifices are equal to the number of adaptions in said side chamber to discharge fuel under pressure.

9. A common rail as defined in claim 7, in which there is a central chamber and two side chambers on either side thereof, and the number of cross-drilled orifices are equal to one-half the number of adaptions in said side chambers to discharge fuel under pressure.

* * * * *